US010994925B2

(12) United States Patent
Lucht

(10) Patent No.: US 10,994,925 B2
(45) Date of Patent: May 4, 2021

(54) STORAGE SYSTEM FOR A SHIPPING CONTAINER

(71) Applicant: Duane Lucht, Winnipeg (CA)

(72) Inventor: Duane Lucht, Winnipeg (CA)

( * ) Notice: Subject to any disclaimer, the term of this patent is extended or adjusted under 35 U.S.C. 154(b) by 158 days.

(21) Appl. No.: 16/443,076

(22) Filed: Jun. 17, 2019

(65) Prior Publication Data

US 2020/0039740 A1 Feb. 6, 2020

(30) Foreign Application Priority Data

Aug. 1, 2018 (CA) ..... CA3013010

(51) Int. Cl.
*B65D 90/02* (2019.01)
*B65D 90/00* (2006.01)
*B65D 88/12* (2006.01)

(52) U.S. Cl.
CPC ..... *B65D 90/0053* (2013.01); *B65D 88/121* (2013.01); *B65D 90/027* (2013.01)

(58) Field of Classification Search
CPC . B65D 90/0053; B65D 90/027; B65D 88/121
USPC ..... 220/1.5; 248/339, 235
See application file for complete search history.

(56) References Cited

U.S. PATENT DOCUMENTS

| | | | | |
|---|---|---|---|---|
| 76,232 | A * | 3/1868 | Morse | |
| 3,900,110 | A * | 8/1975 | Soroka | A47F 5/0006 211/113 |
| RE39,444 | E * | 12/2006 | Rene | B65D 19/12 220/4.31 |
| 7,651,065 | B2 | 1/2010 | Sloan | |
| 8,356,720 | B2 | 1/2013 | Mathews | |
| 2005/0006541 | A1* | 1/2005 | Magnusson | A47B 96/1416 248/235 |

* cited by examiner

*Primary Examiner* — Stephen J Castellano
(74) *Attorney, Agent, or Firm* — Kyle R. Satterthwaite; Ade & Company Inc.; Ryan W. Dupuis

(57) ABSTRACT

A shipping container storage system includes mounting posts that are mountable within the inner or outer channels along the corrugated side walls of a shipping container for supporting various load supporting accessories releasably along the mounting posts. A first mounting bracket configuration allows one or both ends of the mountings posts to be fastened to a perpendicular end surface at the top or bottom end of a channel receiving the mounting post therein. A second mounting bracket configuration includes a hook that allows the mounting posts to be suspended from a rigid anchor loop at a top end of a channel in the shipping container side wall.

20 Claims, 13 Drawing Sheets

STORAGE SYSTEM FOR A SHIPPING CONTAINER

This application claims foreign priority benefits from Canadian Patent Application 3,013,010 filed Aug. 1, 2018, the disclosure of which is hereby incorporated by reference.

FIELD OF THE INVENTION

The present invention relates to a storage system including mounting posts which are securable relative to a shipping container for supporting a variety of load supporting accessories on the mounting posts, for example shelving and the like.

BACKGROUND

Intermodal shipping containers for shipping cargo over land and sea are also known to be used for storage as they are readily available and mass-produced in a cost-effective manner. A typical shipping container is generally rectangular in shape, having rectangular side walls formed of rigid, corrugated sheet material connected between beams extending along the edges of the container. Some of the channels in the corrugated side walls include anchor loops fixed at the top and bottom ends of the channel for securing cargo.

U.S. Pat. No. 7,651,065 by Sloan and U.S. Pat. No. 8,356,720 by Mathews disclose examples of shelving systems adapted to be mounted within a shipping container. Sloan (U.S. Pat. No. 7,651,065) hooks a mounting bar onto the anchor loops but the hooks can be readily dislodged from the anchor hooks by upward contact with the shelves when loading the shelving system. Mathews relies on flexible chains passing through the anchor loops to suspend the shelves of the shelving system, but the flexible nature of the chains results in the shelves being supporting in an unstable manner in which the loaded material can readily fall from the shelves when upwardly contacting the shelves during loading.

SUMMARY OF THE INVENTION

According to one aspect of the invention there is provided a storage system for use with a load supporting accessory for supporting a load thereon and a shipping container having corrugated side walls each formed of inner panel sections in a first common plane at an inner side of the side wall, outer panel sections in a second common plane at an outer side of the side wall, and a plurality of channel sections each connected between one of the inner panel sections and one of the outer panel sections such that each inner panel section together with two adjacent ones of the channel sections defines an outer channel of the side wall open to an exterior and each outer panel section together with two adjacent ones of the channel sections defines an inner channel of the side wall open to an interior, the storage system comprising:

a mounting post arranged to be received in one of the inner and outer channels of the side walls of the shipping container so as to extend in a longitudinal direction along the channel;

a plurality of mounting apertures along the mounting post, each adapted to selectively receive the load supporting accessory therein such that the load can be supported on the mounting post;

a mounting bracket on an end of the mounting post having at least one fastener aperture therein within a mounting surface of the mounting bracket which is oriented perpendicularly to the longitudinal direction of the mounting post such that the mounting bracket is adapted to be fastened to an end surface of the shipping container at an end of the channel receiving the mounting post therein.

Use of fastener apertures in an end face of the mounting bracket that is perpendicular to the longitudinal direction of the mounting post enables the mounting post to be secured into the bottom wall of a tubular top edge beam of the shipping container in a manner which does not penetrate the exterior envelope of the shipping container so that contents of the shipping container remain protected from the elements. The direct fastened connection between the mounting post and the shipping container also enables loads to be supported in a manner which is much more stable than the prior art.

Preferably the mounting post is arranged to be fully received within a boundary of any one of the inner and outer channels of shipping container.

The mounting post may be arranged to span a full depth of the channel within which the mounting post is received from the first common plane to the second common plane and to span a full width of the panel section of the channel receiving the mounting post therein between opposing edges of the panel section which are joined to the adjacent ones of the channel sections of the channel.

In some instances, the mounting post also spans a full height of any one of the inner and outer channels of the shipping container in which a second bracket is provided on an end of the mounting post opposite the mounting bracket, the second bracket having at least one fastener aperture therein within a mounting surface of the second bracket which is oriented perpendicularly to the longitudinal direction of the mounting post such that the mounting bracket is adapted to be fastened to a second end surface of the shipping container at an end of the channel receiving the mounting post therein.

The mounting bracket may include a fastener portion which is received through an open end of the mounting post and a threaded fastener releasable joining the mounting bracket to the mounting post in which the threaded fastener is perpendicular to the longitudinal direction and parallel to the first and second common planes.

The mounting bracket preferably includes a flange portion protruding laterally outward beyond a boundary of the mounting post in which the flange portion at least partly defines the mounting surface that locates said at least one fastener aperture therein such that the fastener aperture is located outward of the boundary of the mounting post.

The mounting bracket may include two laterally opposed flange portions which are generally triangular in shape such that the two flange portions and the mounting post collectively span the end surface at the end of the channel receiving the mounting post therein.

The mounting bracket may also include an auxiliary aperture in the mounting surface of the mounting bracket within the boundary of the mounting post in which the auxiliary aperture is arranged to receive a threaded fastener arranged to be fastened to the end surface of the shipping container at the end of the channel receiving the mounting post therein.

According to a second aspect of the present invention there is provided a storage system for use with a load supporting accessory for supporting a load thereon and a shipping container having corrugated side walls each formed of inner panel sections in a first common plane at an inner side of the side wall, outer panel sections in a second common plane at an outer side of the side wall, a plurality of channel sections each connected between one of the inner panel sections and one of the outer panel sections such that each inner panel section together with two adjacent ones of the channel sections defines an outer channel of the side wall open to an exterior and each outer panel section together with two adjacent ones of the channel sections defines an inner channel of the side wall open to an interior, and a plurality of rigid anchor loops formed at respective ends of some of the channels of each side wall, the storage system comprising:

a mounting post arranged to be received in one of the inner channels of the side walls of the shipping container so as to extend in the longitudinal direction along the channel;

a plurality of mounting apertures along a front side of the mounting post opposite a back side of the mounting post, each mounting aperture being adapted to selectively receive the load supporting accessory therein such that the load can be supported on the mounting post; and a mounting bracket on an end of the mounting post including a hook formed thereon comprising a connection portion extending longitudinally outward from the back side of the mounting post and a hooking portion protruding forwardly from the connection portion towards the front side of the mounting post so as to be arranged for hooking into one of the rigid anchor loops at a top end of the channel receiving the mounting post therein.

Use of a hook which protrudes forwardly from a back side of the mounting post enables the hook to be retained between the anchor loop of the container and the corresponding channel of the corrugated side wall. The hook can only be released by pivoting the bottom of the mounting post upwardly and inwardly about the anchor loop; however, this motion to release the hook is prevented by loading a load onto the mounting post.

Preferably the mounting post is arranged to be fully received within a boundary of any one of the inner channels of shipping container in which the mounting post spans a full depth of the channel within which the mounting post is received from the first common plane to the second common plane and in which the mounting post spans a full width of the panel section of the channel receiving the mounting post therein between opposing edges of the panel section which are joined to the adjacent ones of the channel sections of the channel.

The mounting bracket may include a fastener portion which is received through an open end of the mounting post and a threaded fastener releasable joining the mounting bracket to the mounting post in which the threaded fastener is perpendicular to the longitudinal direction and parallel to the first and second common planes.

The connection portion of the hook preferably includes a front edge positioned relative to the back side of the mounting post such that the front edge of the connection portion of the hook is arranged to be engaged against a back side of the anchor loop when the back side of the mounting post abuts the panel section of the channel along a full length of the mounting post in the longitudinal direction.

The connection portion of the hook may be formed of plate material fully spanning in a depth direction between the back side of the anchor loop and the panel section of the channel against which the back side of the mounting post is arranged to be abutted.

The connection portion of the hook may include a fastener portion which is received through an open end of the mounting post and a threaded fastener releasable joining the fastener portion mounting bracket to the mounting post in which the threaded fastener is perpendicular to the longitudinal direction and parallel to the first and second common planes.

The system may comprise two mounting posts which are identical such that each mounting post has a mounting bracket with a hook formed thereon, and a cross beam adapted to be connected perpendicularly between the two mounting posts when the mounting posts are mounted on respective anchor loops on opposing side walls of the shipping container.

According to a third aspect of the present invention there is provided a storage system in combination with load supporting accessories and a shipping container having corrugated side walls each formed of inner panel sections in a first common plane at an inner side of the side wall, outer panel sections in a second common plane at an outer side of the side wall, a plurality of channel sections each connected between one of the inner panel sections and one of the outer panel sections such that such that each inner panel section together with two adjacent ones of the channel sections defines an outer channel of the side wall open to an exterior and each outer panel section together with two adjacent ones of the channel sections defines an inner channel of the side wall open to an interior, and a plurality of rigid anchor loops formed at respective ends of some of the channels of each side wall, the storage system comprising:

a first mounting post arranged to be received in one of the inner channels of the side walls of the shipping container so as to extend in a longitudinal direction along the channel;

a plurality of mounting apertures along the first mounting post, each adapted to selectively receive one of the load supporting accessories therein;

a first mounting bracket on an end of the first mounting post having at least one fastener aperture therein within a mounting surface of the mounting bracket which is oriented perpendicularly to the longitudinal direction of the mounting post such that the mounting bracket is adapted to be fastened to an end surface of the shipping container at an end of the channel receiving the mounting post therein;

a second mounting post arranged to be received in one of the inner channels of the side walls of the shipping container so as to extend in the longitudinal direction along the channel;

a plurality of mounting apertures along a front side of the second mounting post opposite a back side of the mounting post, each mounting aperture being adapted to selectively receive one of the load supporting accessories therein such that the load can be supported on the mounting post;

a second mounting bracket on an end of the second mounting post including a hook formed thereon comprising a connection portion extending longitudinally outward from the back side of the second mounting post and a hooking portion protruding forwardly from the connection portion towards the front side of the second mounting post so as to be arranged for hooking into one of the rigid anchor loops at a top end of the channel receiving the mounting post therein; and a load supporting device coupled horizontally across both the load support accessory of the first mounting post and the load supporting accessory of the second mounting post.

BRIEF DESCRIPTION OF THE DRAWINGS

Various embodiments of the invention will now be described in conjunction with the accompanying drawings in which.

In the drawings like characters of reference indicate corresponding parts in the different figures.

DETAILED DESCRIPTION

Figure 1:
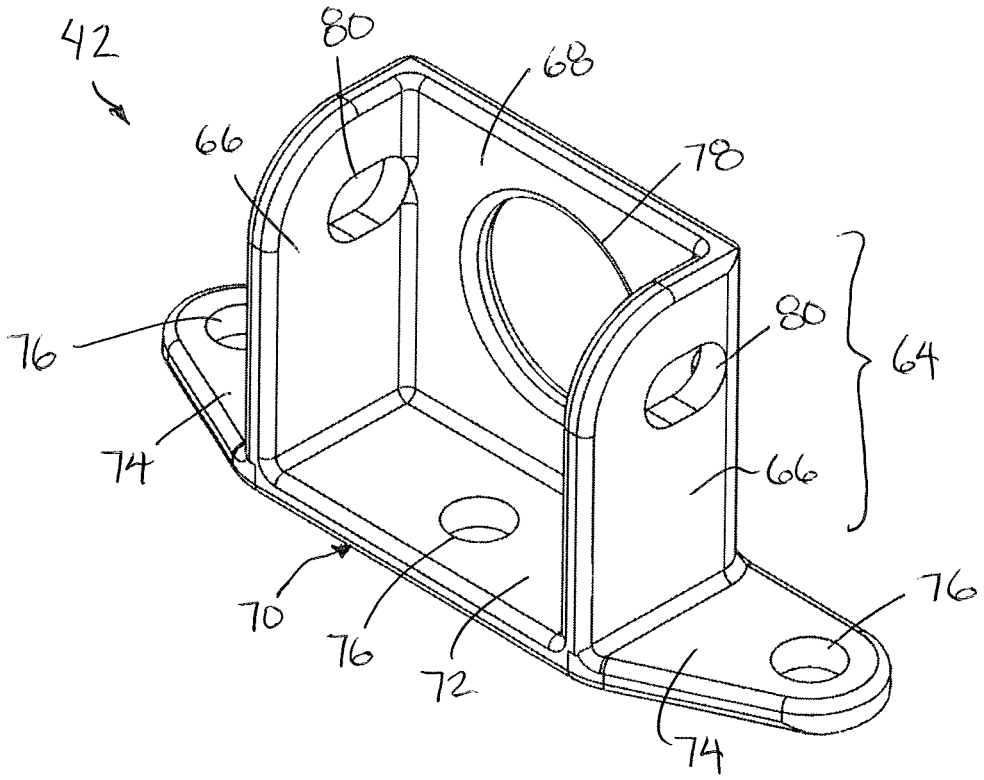
FIG. 1 is a first perspective view of a rear side of a first mounting bracket of the storage system.
Figure 2:
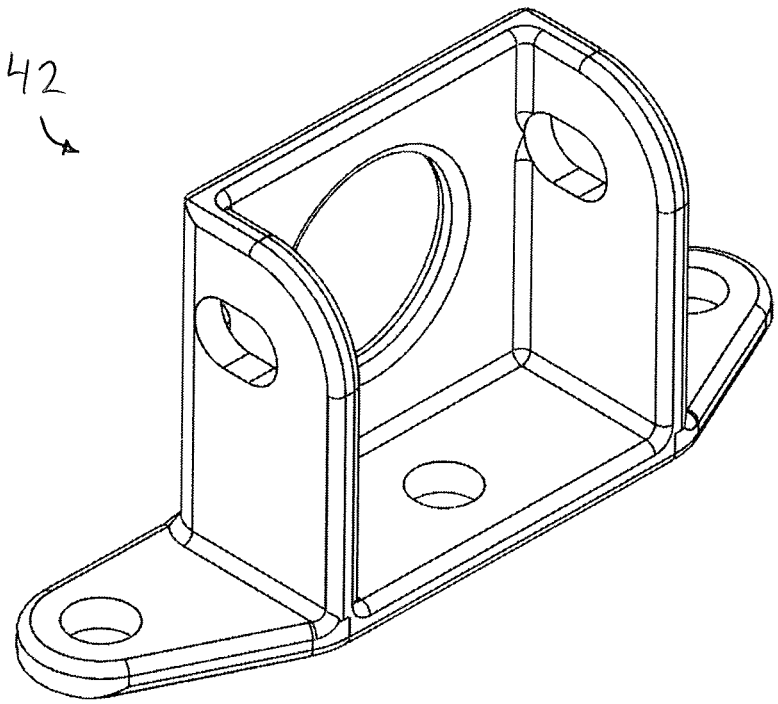
FIG. 2 is a second perspective view of the rear side of the first mounting bracket.
Figure 3:
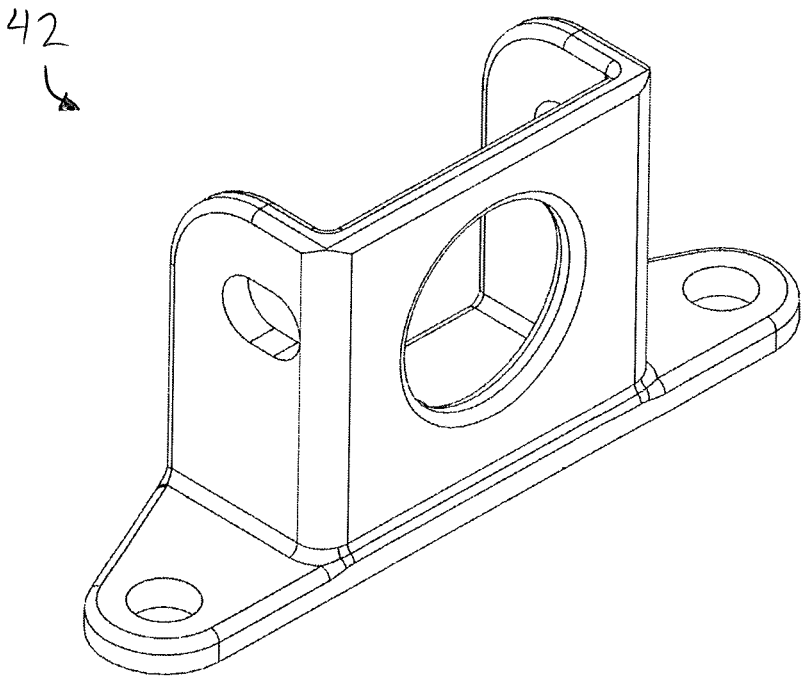
FIG. 3 is a first perspective view of a front side of the first mounting bracket.
Figure 4:
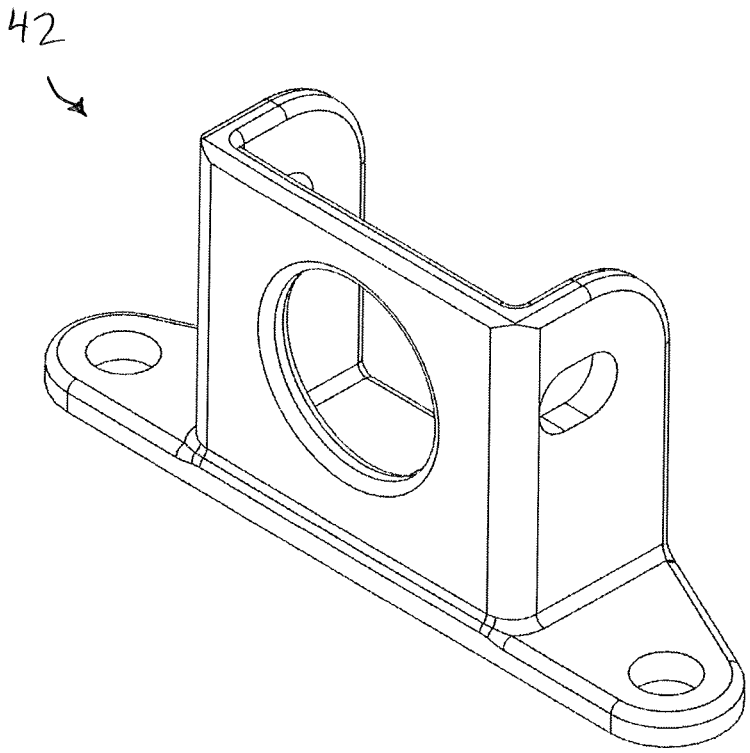
FIG. 4 is a second perspective view of the front side of the first mounting bracket.
Figure 5:
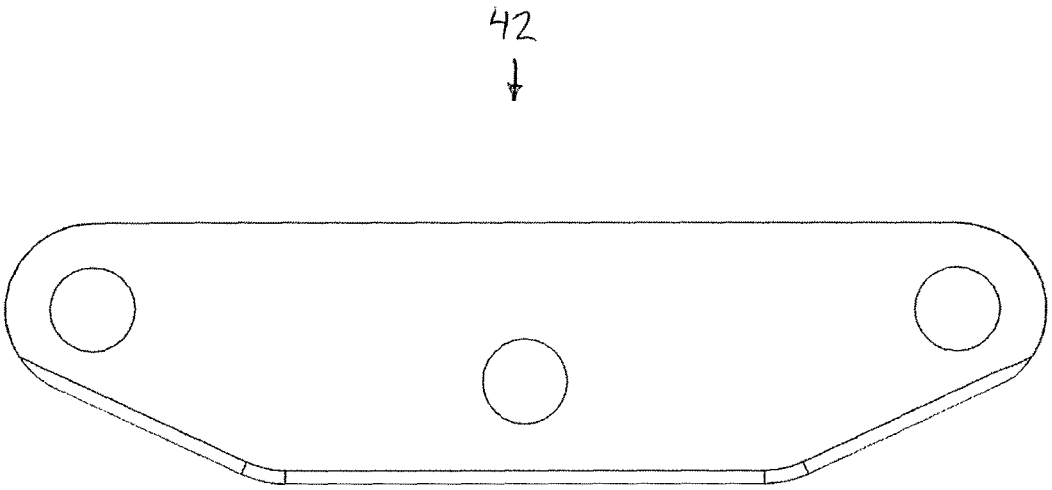
FIG. 5 is a bottom view of the first mounting bracket.
Figure 6:
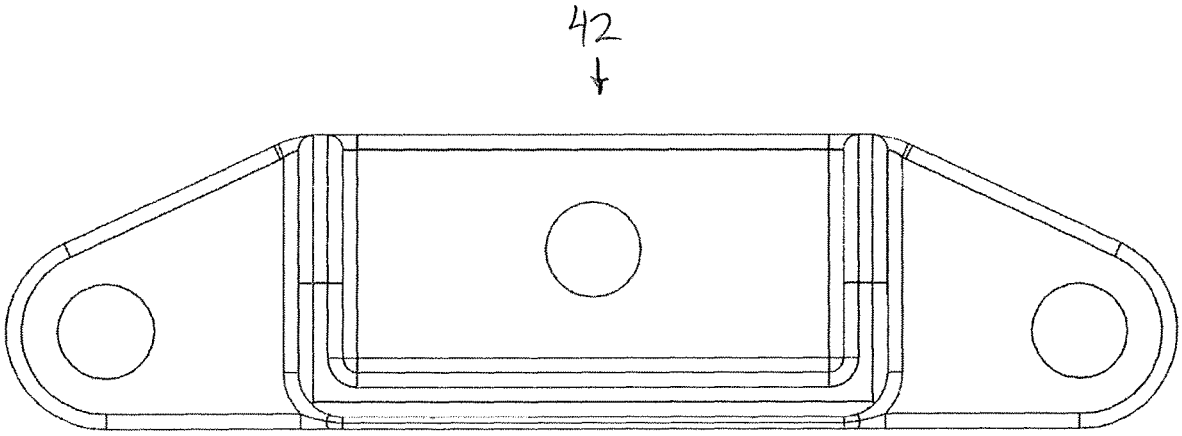
FIG. 6 is a top plan view of the first mounting bracket.
Figure 7:
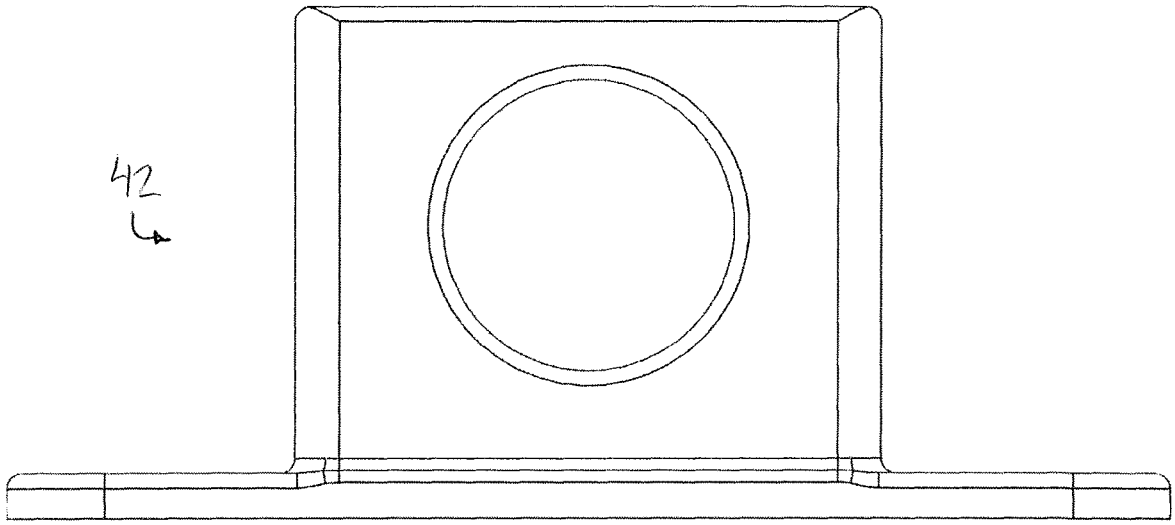
FIG. 7 is a front elevational view of the first mounting bracket.
Figure 8:
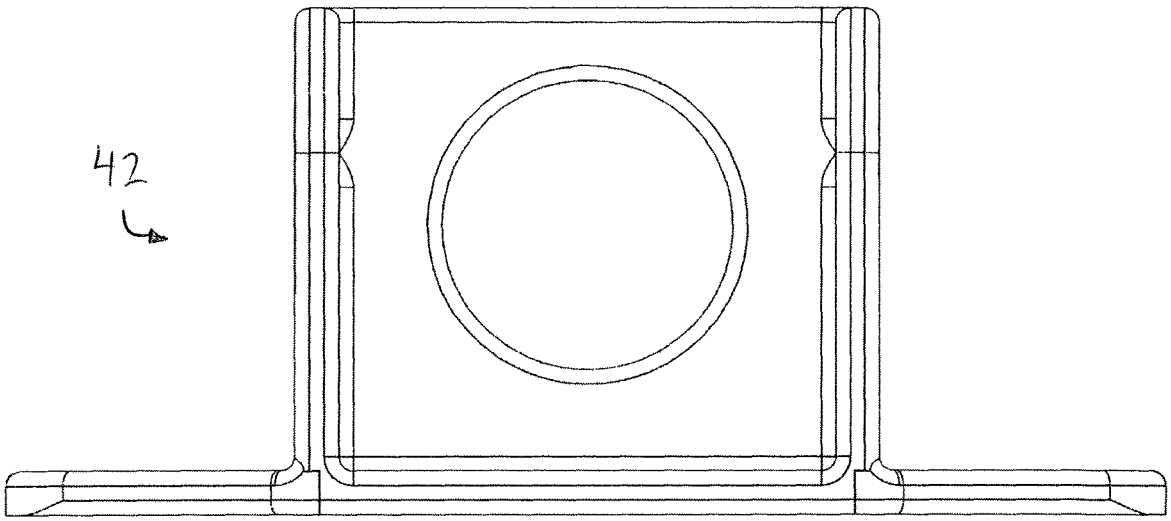
FIG. 8 is a rear elevational view of the first mounting bracket.
Figure 9:
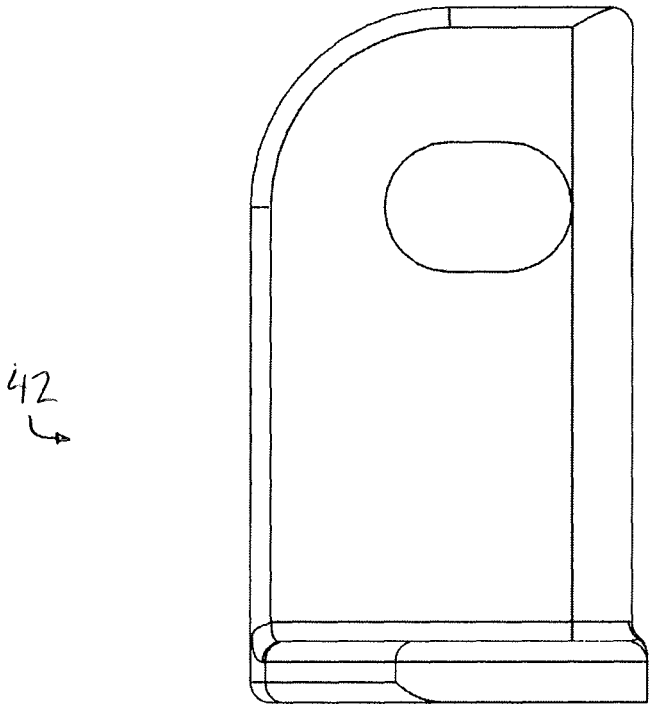
FIG. 9 is a first side elevational view of the first mounting bracket.
Figure 10:
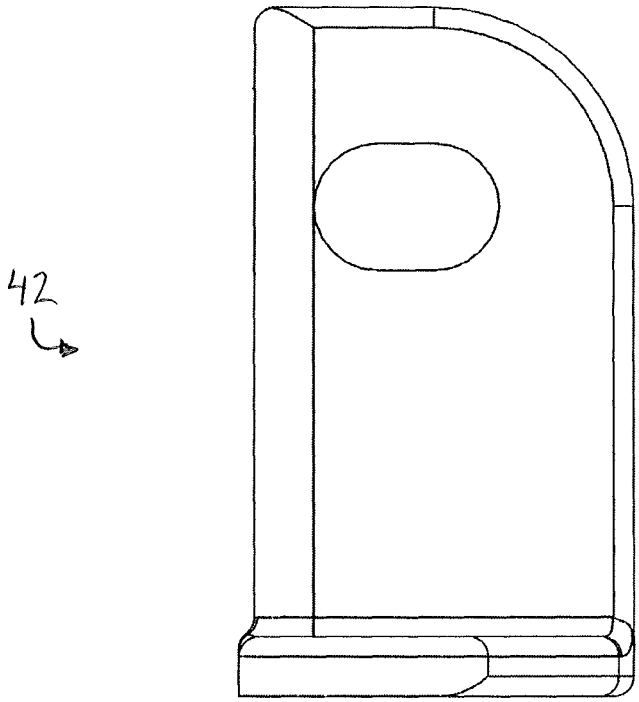
FIG. 10 is a second side elevational view of the first mounting bracket.
Figure 11:
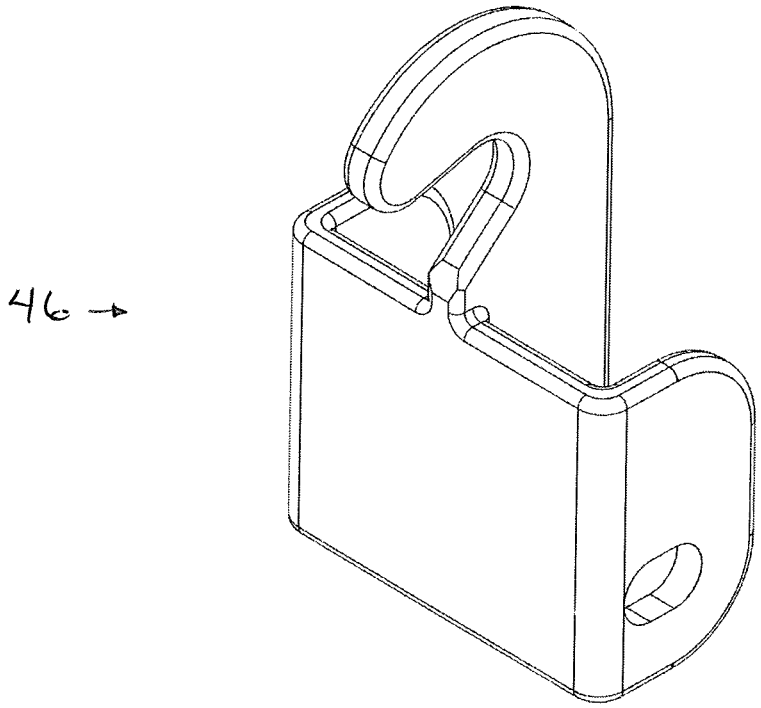
FIG. 11 is a first perspective view of a front side of a second mounting bracket of the storage system.
Figure 12:
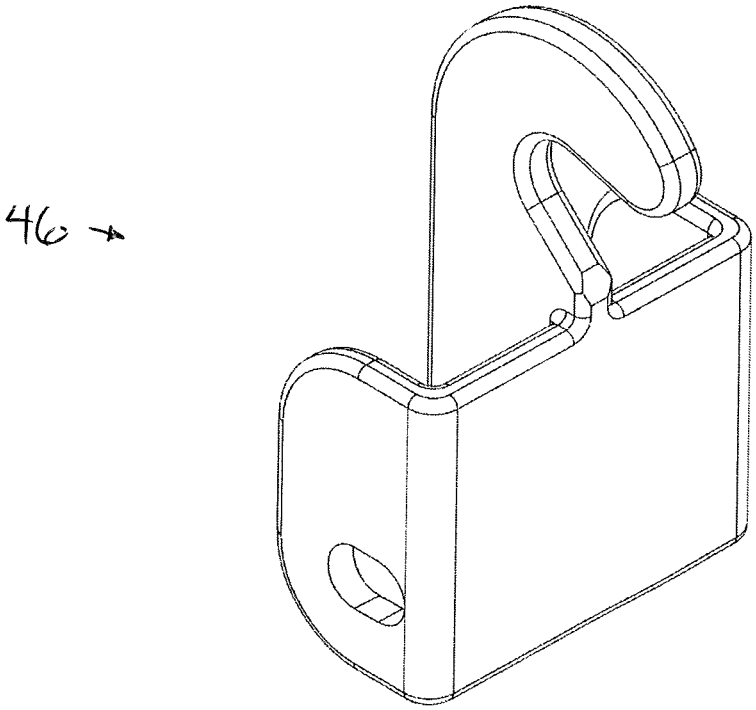
FIG. 12 is a second perspective view of the front side of the second mounting bracket.
Figure 13:
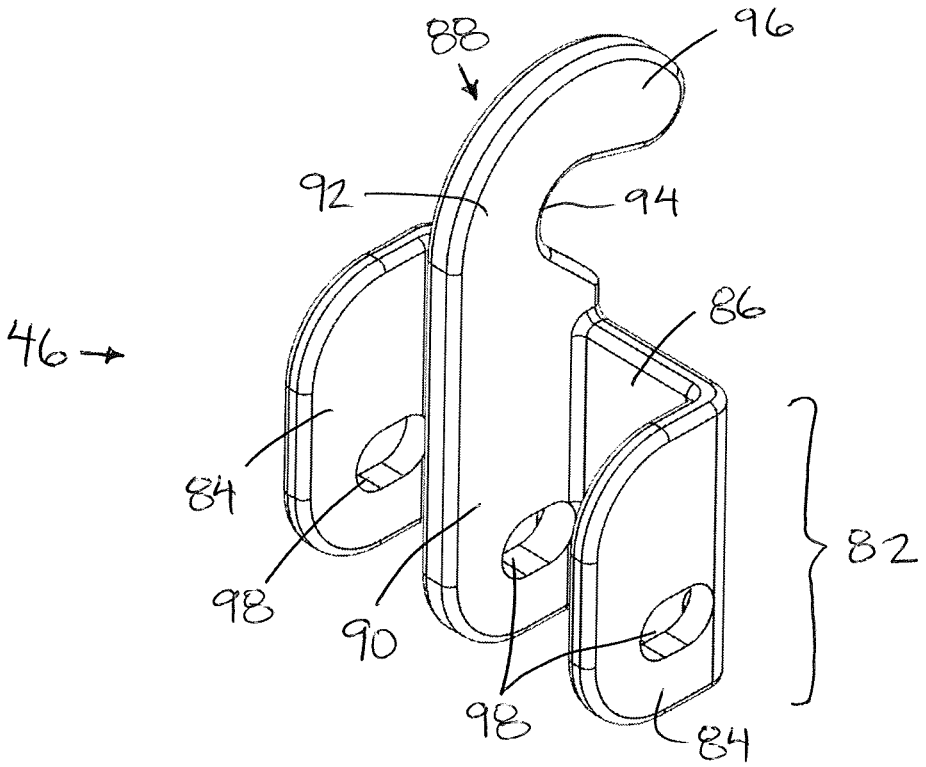
FIG. 13 is a first perspective view of a rear side of the second mounting bracket.
Figure 14:
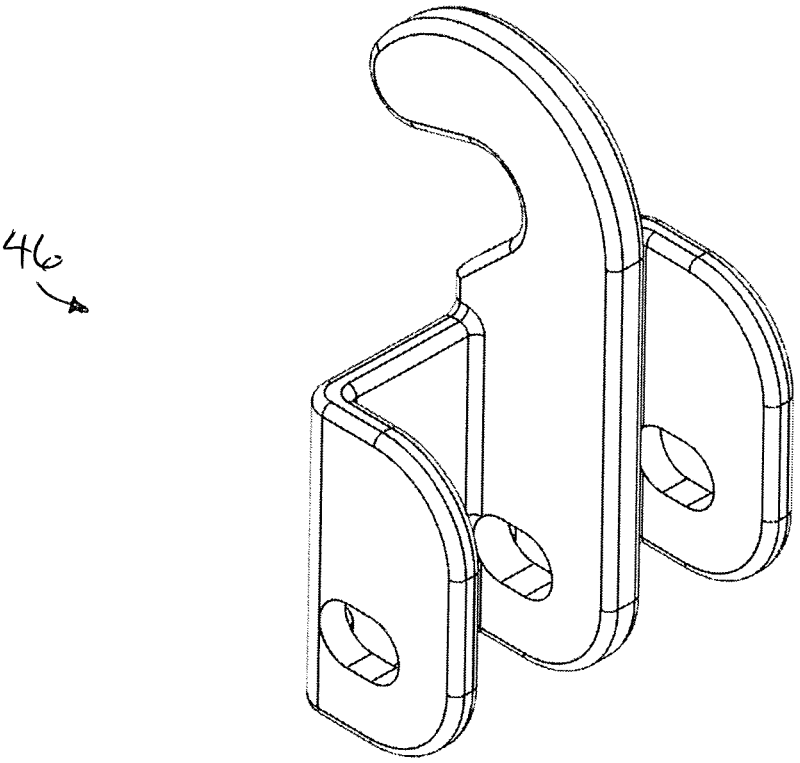
FIG. 14 is a second perspective view of the rear side of the second mounting bracket.
Figure 15:
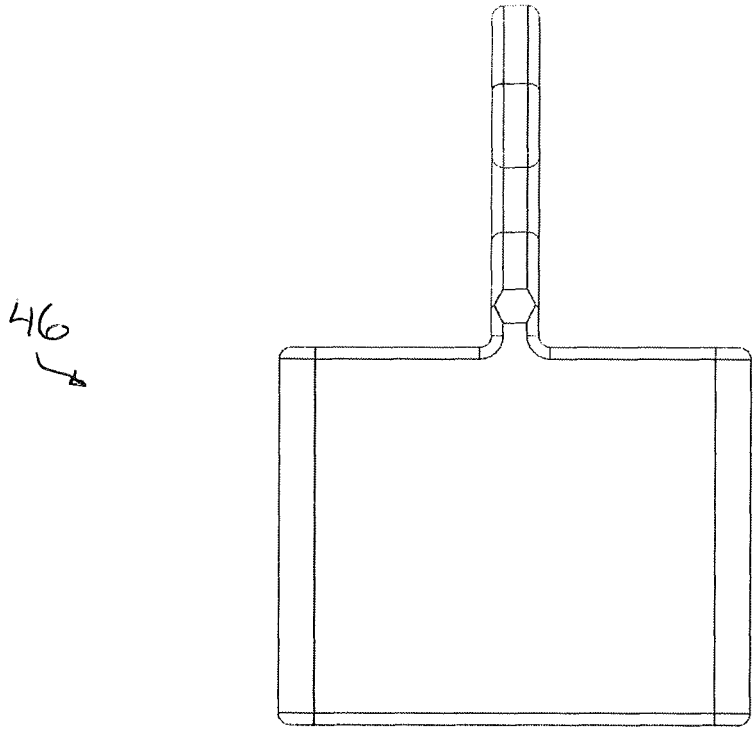
FIG. 15 is a front elevational view of the second mounting bracket.
Figure 16:
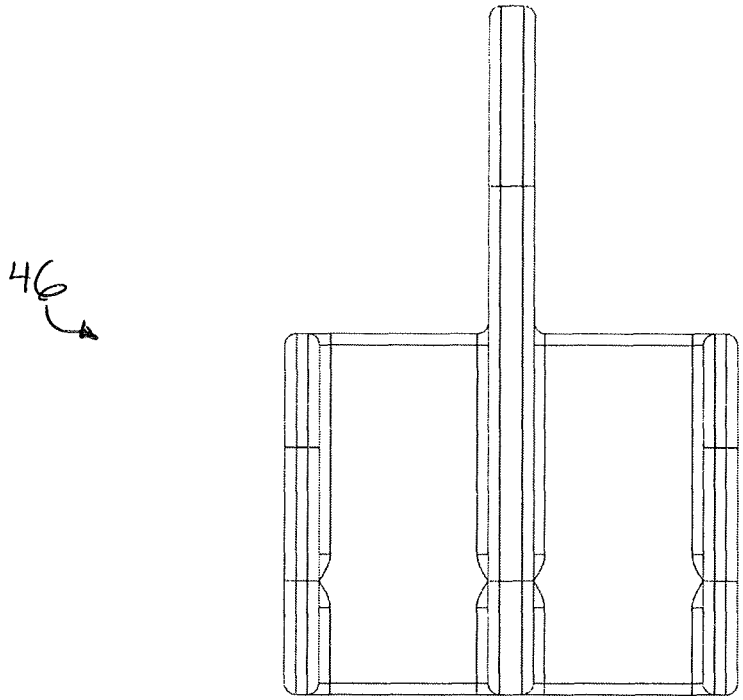
FIG. 16 is a rear elevational view of the second mounting bracket.
Figure 17:
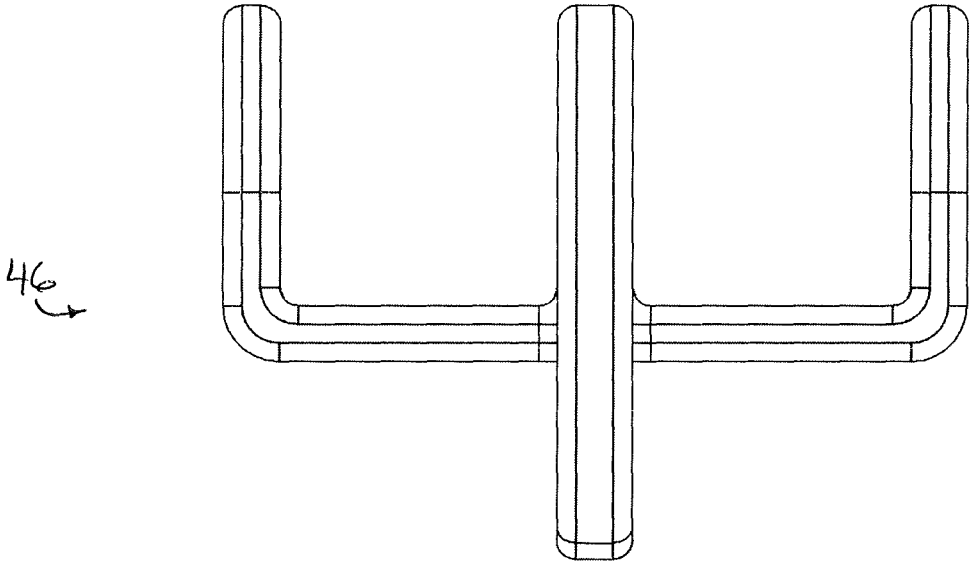
FIG. 17 is a top plan view of the second mounting bracket.
Figure 18:
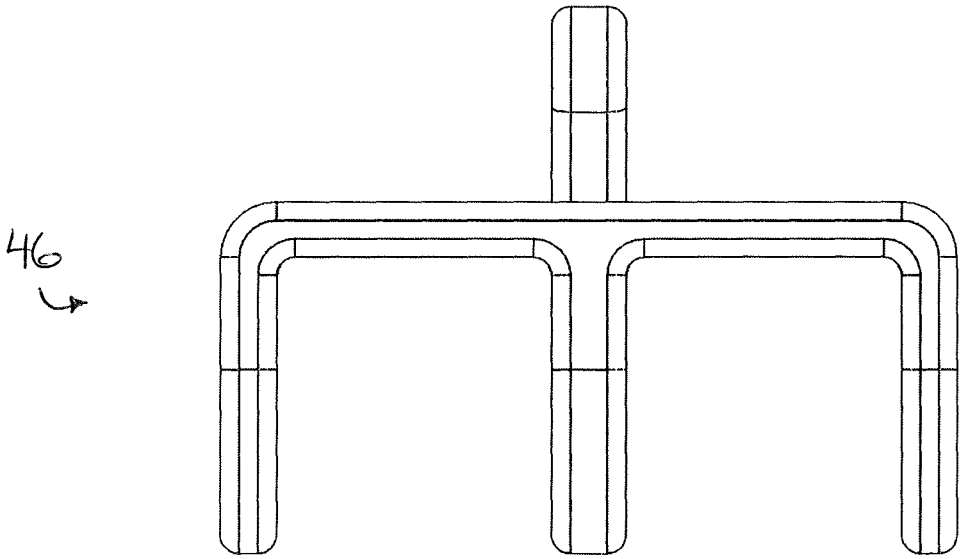
FIG. 18 is a bottom view of the second mounting bracket.
Figure 19:
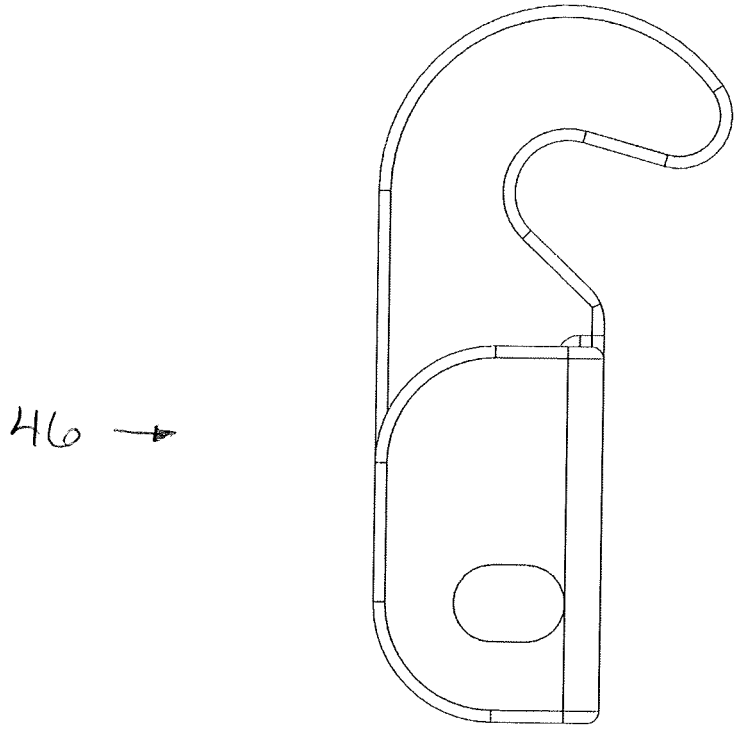
FIG. 19 is a first side elevational view of the second mounting bracket.
Figure 20:
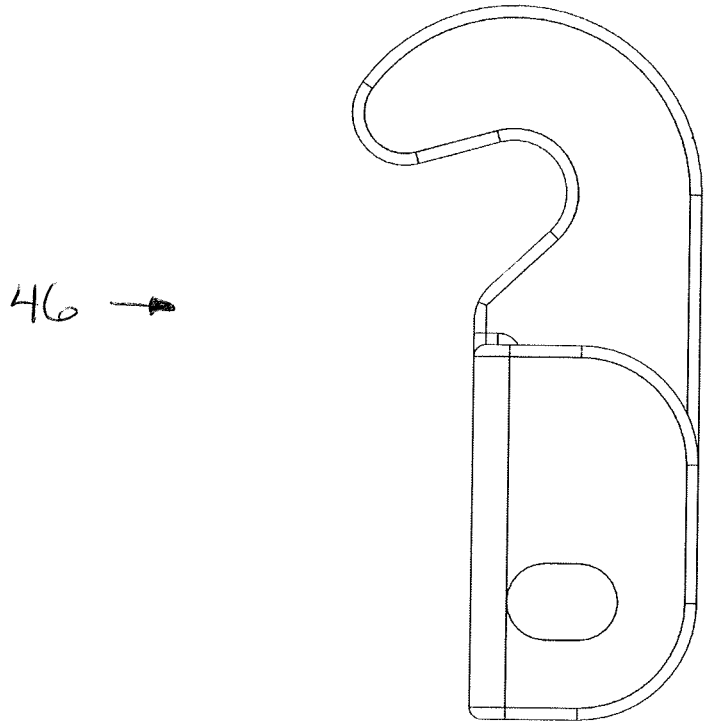
FIG. 20 is a second side elevational view of the second mounting bracket.
Figure 21:
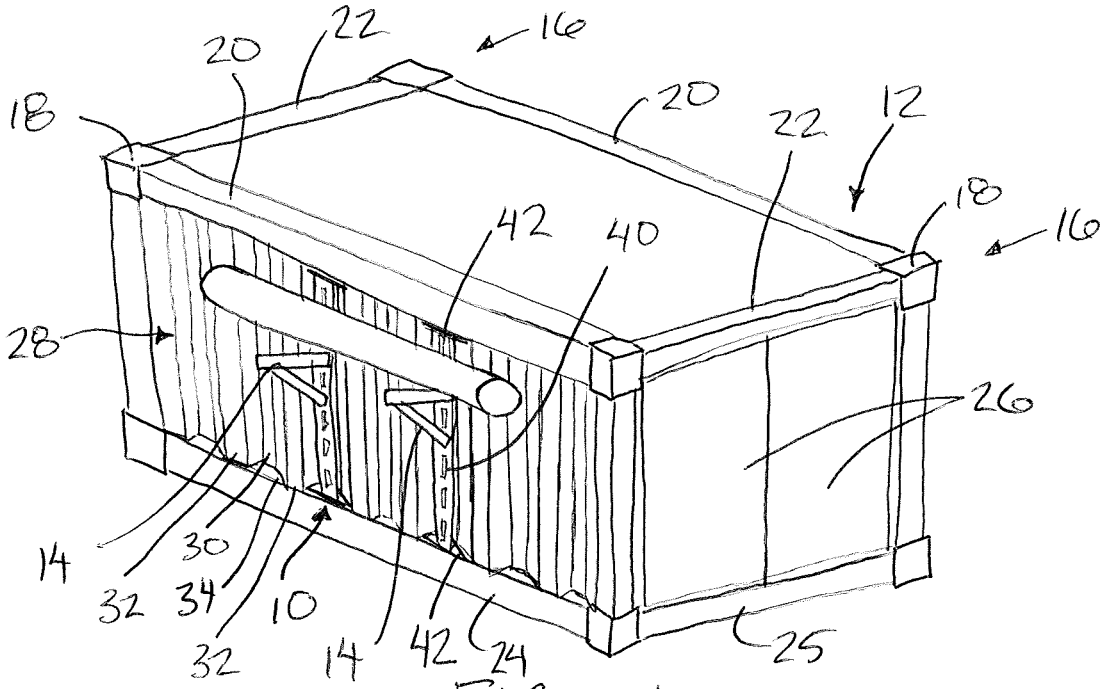
FIG. 21 is a schematic view of a shipping container upon which the storage system is supported.
Figure 23:
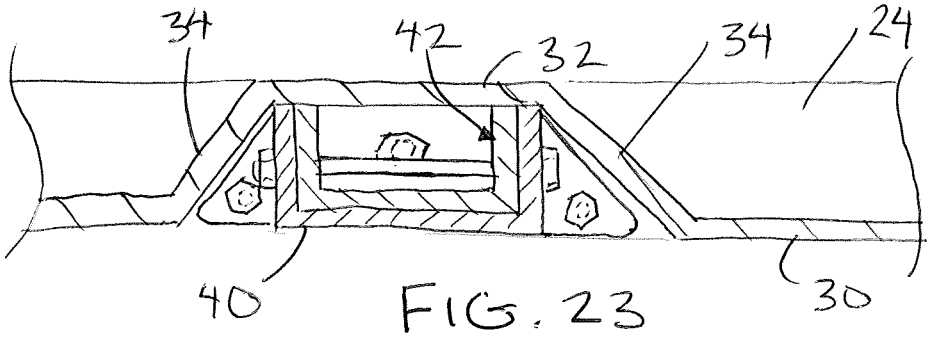
FIG. 23 is a sectional view along the line 23-23 in FIG. 22.
Figure 25:
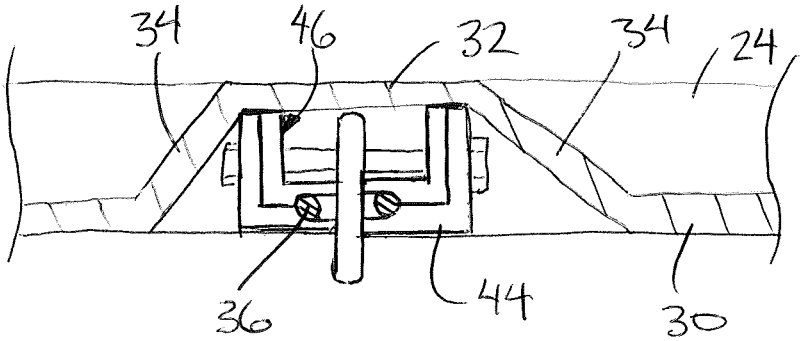
FIG. 25 is a sectional view along the line 25-25 in FIG. 24.

Referring to the accompanying figures there is illustrated a storage system generally indicated by reference numeral 10. The storage system 10 is particularly suited for use with a shipping container 12 and a variety of the load supporting accessories 14 for supporting a load internally or externally on the side walls of the shipping container.

A typical shipping container is generally rectangular in shape and elongate in a longitudinal direction between two opposing ends 16. Corner connectors 18 are provided at each of the corners of the container for anchoring to various structures or for connection to various container handling equipment. A pair of top side beams 20 extend in the longitudinal direction at the top of the container along respective opposing sides of the container for connection between two of the corner connectors 18. The top side beams 20 comprises a rigid tubular member of rectangular cross-section. A pair of end beams 22 are connected in a lateral direction between the corner connectors at each of the opposing ends of the container at the top side of the container. A pair of bottom side beams 24 extend in the longitudinal direction at the bottom of the container along respective opposing sides of the container for connection between two of the corner connectors 18 at the opposing sides of the bottom of the container. Bottom end beams 25 may be connected in a lateral direction between the corner connectors at each of the opposing ends of the container at the bottom side of the container. A pair of access doors 26 are typically provided at the opposing ends 16 of the container.

The shipping container typically also includes two side walls 28 spanning the full height of the container between the top side beam 20 and the bottom side beam 24 at each of the laterally opposing sides of the container. Each side wall 28 comprises a rigid, corrugated sheet of metal joined at the top edge to the flat bottom of the top side beam 20 and joined at the bottom edge to the flat top side of the bottom side beam 24.

Each side wall 28 includes a plurality of inner panel sections 30 which are generally flat and rectangular in shape to span the full height of the side wall with the plurality of inner panel sections being longitudinally spaced apart from one another within a common inner plane. Similarly, each side wall includes a plurality of outer panel sections 32 which are generally flat and rectangular in shape to span the full height of the side wall in which the outer panel sections are at longitudinally spaced apart positions from one another within a common outer plane. More particularly each outer panel section is located between two inner panel sections in the longitudinal direction of the container.

A plurality of channel sections 34 of each side wall are connected between the inner and outer panel sections to form a continuous wall. Each channel section is a flat and rectangular shaped panel that spans the full height of the side wall while being oriented at a slope to both the common inner plane and the common outer plane. More particularly each channel section is connected to the side edge of one inner panel and the side edge of one outer panel.

In this manner the side walls each define a plurality of inner channels open to the interior of the container and a plurality of outer channels open to the exterior of the container. Each inner channel is generally defined by one outer panel section 32 and the two adjacent channel sections 34 connected thereto. Likewise, each outer channel is defined by one inner panel section 30 and the two adjacent channel section 34 connected thereto.

The bottom wall of the rectangular tubular member forming the top side beam defines a continuous end surface enclosing the ends of each of the channels while being oriented perpendicular to the longitudinal direction of the channels at the top end of the channels. Similarly, the bottom side beam has a top wall defining an end surface oriented perpendicularly to the longitudinal directions of the channels for enclosing the bottom end of each channel. The bottom side beam is typically a U-shaped channel having an open side facing laterally outwardly to an exterior of the container.

Typical shipping containers further include a plurality of rigid anchor loops 36 welded to the bottom wall of the top side beam and welded to the top wall of the bottom side beam in alignment with selected ones of the inner channels within the side walls of the shipping container.

The mounting system 10 according to the present invention generally includes (i) a first mounting post 40 for use with upper and lower first mounting brackets 42 which mount the top and bottom ends of the mounting post securely relative to any one of the inner and outer channels of the side walls of the shipping container such that the mounting post is wholly received within the boundary of the channel, and (ii) a second mounting post 44 for use with a second mounting bracket 46 at the top end of the second mounting post to support the mounting post securely relative to any one of the inner channels of the side walls of the shipping container that locates a rigid anchor loop therein.

In both instances, the mounting post 40 or 44 is an elongate channel which is generally U-shaped in cross sections so as to define two side flanges 48 at laterally opposing sides of the post which span between the opposing front and back sides of the mounting post, and a crown 50 joined between the front edges of the two side flanges 48. A plurality of mounting aperture is 52 are provided at longitudinally spaced apart positions within the crown 50 at the front side of the channel. Each mounting aperture 52 defines a socket for receiving one of the load supporting accessories 14 releasably retained therein. Examples of load supporting accessories include shelf supports, beam supports and the like. Each load supporting accessory includes a connector portion that mates within the socket formed by the selected mounting aperture 52. In some embodiments the mounting apertures may be configured for mating with conventional load supporting accessories which are commercially available under the name A-track or E-track.

Each post further includes a plurality of fastener apertures 54 at longitudinally spaced apart positions within each side flange 48. The fastener apertures can also be used for connection of various load supporting accessories onto the mounting posts.

Figure 22:
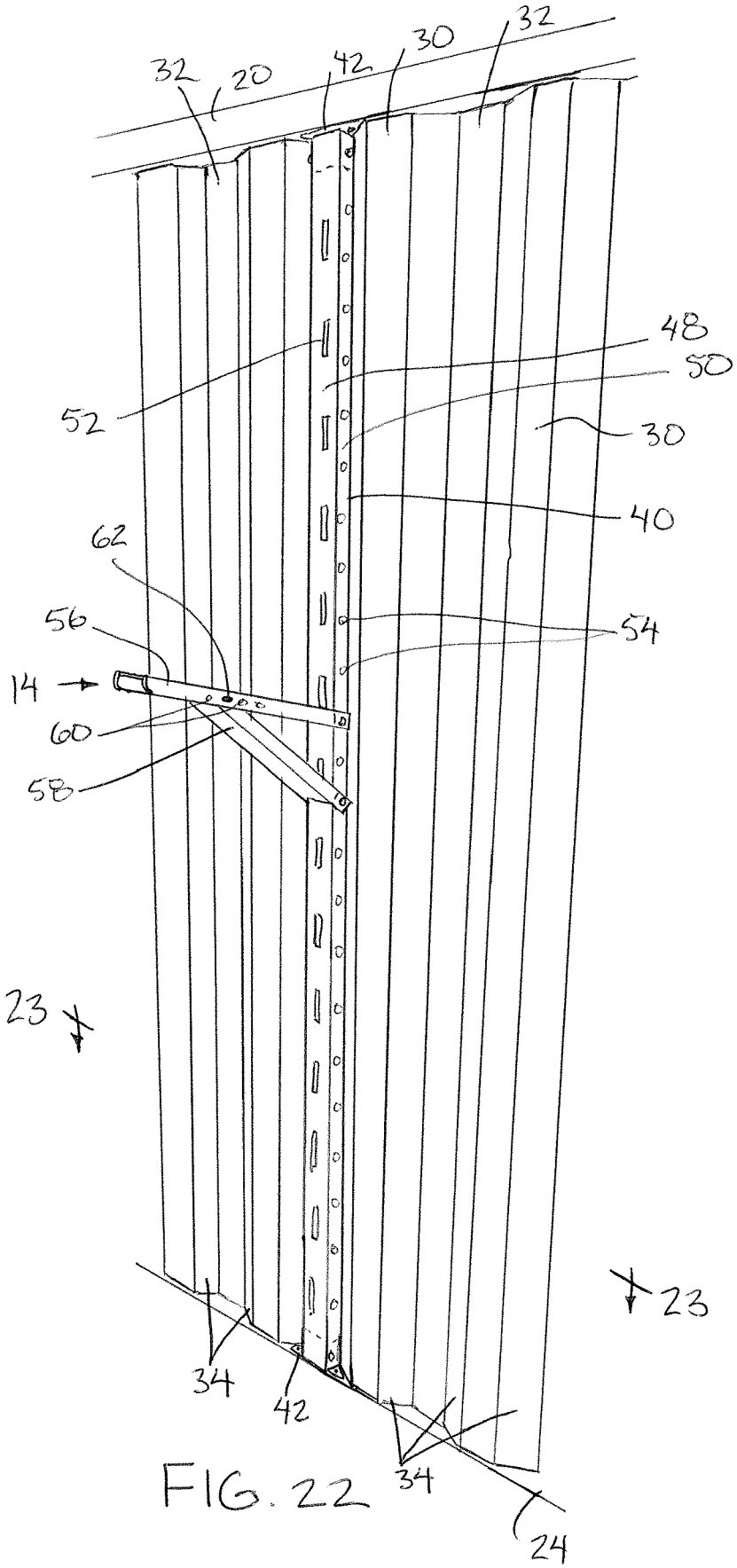
FIG. 22 is a perspective view of a first mounting post supported by the first mounting bracket at an interior of a side wall of the shipping container.
Figure 24:
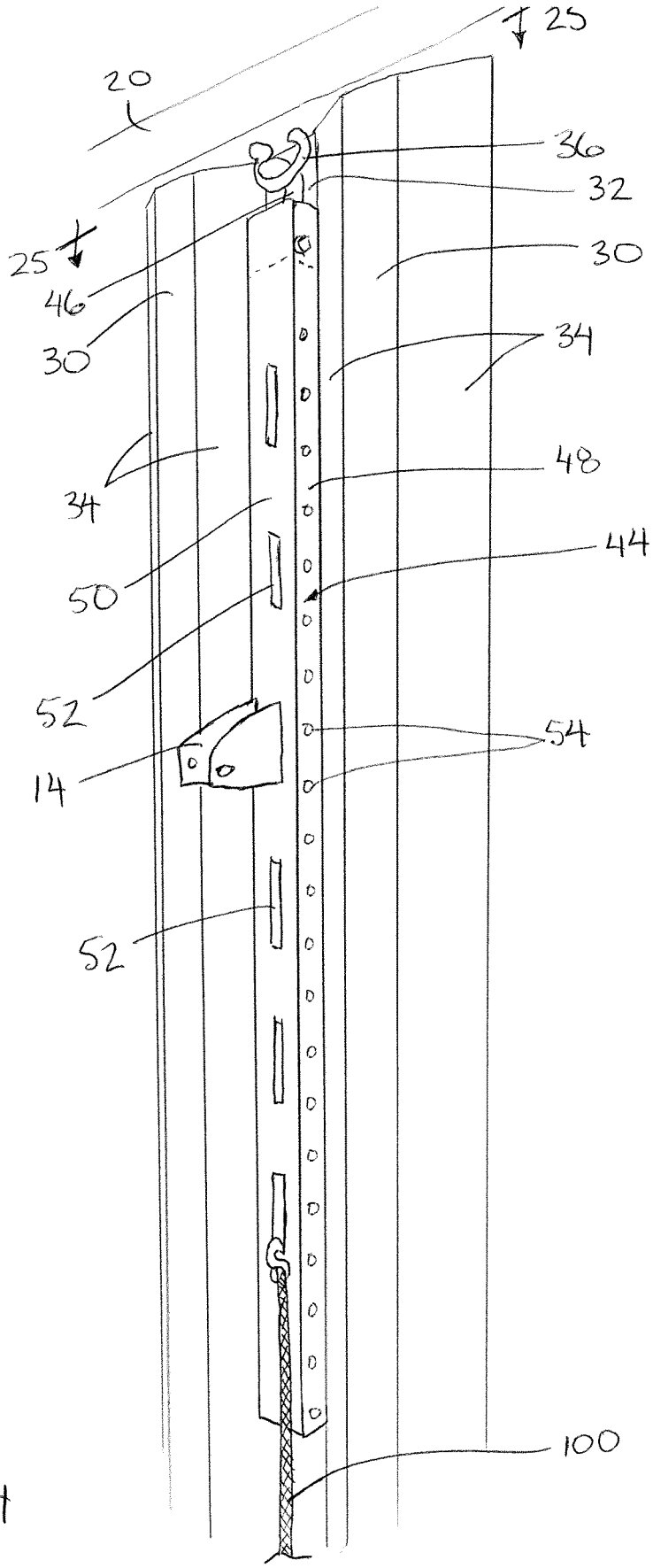
FIG. 24 is a perspective view of a second mounting post supported by the second mounting bracket at the interior of the side wall of the shipping container.

One example of a load supporting accessory is shown in FIG. 22 in the form of a shelf supporting bracket having a top bar 56 having a pair of mounting tabs protruding longitudinally beyond the end of the top bar at the inner end thereof through which a laterally oriented fastener can be used to couple the mounting tabs pivotally to an aligned pair of the fastener apertures 54 in the post. A bottom bar 58 is also provided having similar mounting tabs protruding from the inner end thereof through which a laterally oriented fastener can be inserted in alignment with a pair of the fastener apertures 54 in the post below the pivotal connection of the top bar. The bottom bar 58 is shorter in length than the top bar and includes a laterally oriented locking aperture extending through both opposing sides of the bottom bar at the outer end thereof. A plurality of cooperating pairs of locking apertures 60 are provided in opposing sides of the top bar at longitudinally spaced positions along the top bar for selective alignment with the locking aperture at the outer end of the bottom bar to receive a transverse locking pin 62 inserted therethrough. By selecting which of the fastener apertures in the mounting post at the inner ends of the top and bottom bar are pinned to, together with selecting which of the locking aperture is 60 in the top bar receives the locking pin 62 for pinning the outer end of the bottom bar to the top bar, the overall height of both bars and the angular orientation of the top bar relative to the mounting post can be adjusted for directly supporting objects on the upper surface of the top bar or supporting a shelf thereon as may be desired.

Both of the first mounting post and the second mounting post are sized such that the post spans the full width of the panel section of the channel within which it is received from a first side 48 located at one edge of the panel section joined to one of the adjacent channel sections to the other side 48 located at the other edge of the panel section joined to a second channel section of the respective channel. The depth of the side 48 of both posts is also arranged such that the posts span the full depth of the channel from the inner plane of the inner panel sections to the outer plane of the outer panel sections regardless of which channel the mounting post is received in. The front side of the mounting post thus lies within one of the common inner plane or the common outer plane depending upon whether the post is mounted within an inner channel or an outer channel.

In the instance of the first mounting post 40, the mounting post is further arranged to span the full height of the channel such that an upper first mounting bracket 42 at the top end can be fastened to the bottom wall of the corresponding top side beam 20 while the lower first mounting bracket 42 at the bottom end of the post can be secured to the top wall of the bottom side beam 24.

In the instance of the second mounting post 44, in some instances the post may span near the full height of the channel for cooperation with a second mounting bracket at both top and bottom ends, or alternatively the second mounting post may only hang partway along the length of the channel from a top end of the channel where the second mounting bracket 46 secures the top end of the second mounting post in proximity to the top side beam 20.

Turning now more particularly to the configuration of the first mounting bracket 42, the bracket includes a fastener portion 64 which is received within the interior of the boundary of the mounting post defined by the two side 48 and the crown 50 of the post. The fastener portion 64 similarly comprises a U-shaped channel having two side flanges 66 which are parallel and spaced apart from one another at opposing sides of the bracket and a bridge portion 68 connected between the two side flanges at the front side thereof. The lateral width or outer dimension of the fastener portion is defined by the two side flanges which are spaced apart so as to be received between the two sides 48 of the mounting post in close proximity thereto. The depth of the side flanges 66 is also sized to be received along the inner surfaces of the sides 48 of the mounting post between the crown 50 at the front side of the post and the rear edges of the two side flanges 48 at the rear of the post. In this manner the rear edges of the side flanges 66 of the mounting bracket are engaged against the panel section of the channel in the mounted position similarly to the rear edges of the side flanges 48 of the mounting posts.

The fastener portion 64 of the first mounting bracket protrudes slightly through the open end of the mounting post for connection to an end plate 70 mounted perpendicularly across the end of the fastener portion for enclosing the end of the channel forming the fastener portion. The end plate is generally trapezoidal in shape including a rectangular centre section 72 spanning the end of the mounting post, and two side sections 74 which are triangular in shape and which protrude laterally outwardly from opposing sides of the centre section 74 such that one edge of each side section is co-linear with the centre section at the front side of the mounting bracket. The centre section 72 defines a mounting surface internally within the mounting post while the two side sections 74 define mounting surfaces externally of the boundary of the mounting post. Collectively the end of the mounting post and the two side sections 74 span an area equal to the area of the end plate 70 which is suitably sized and shaped for substantially fully spanning the end surface of the channel receiving the mounting post therein.

Each of the centre section 72 and the two side sections 74 includes a respective fastener aperture 76 formed therein which is suitable for receiving a threaded fastener for fastening the end plate 70 to the end surface at the top or bottom end of the channel receiving the respective mounting post therein. An access hole 78 is provided centrally within the bridge flange 68 of the fastener portion of the first mounting bracket to provide tool access for tightening and releasing a fastener from the centre aperture 76. The access hole 78 also has the benefit of reducing material usage in forming the first mounting bracket to reduce the weight of the bracket as well.

The access hole 78 in the front side of the first mounting bracket has the additional benefit of functioning similarly to the existing anchor loops 36 provided on the shipping container. The anchor loops 36 in a shipping container are typically only provided on a few selected inner channels along the interior of the container. The first mounting bracket 42 however can be mounted at the top or bottom end of any inner or outer channel and defines an anchoring location within a channel that otherwise is not provided with an existing anchor loop 36. The access hole 78 is sufficiently large in diameter to readily accept the hook at the end of a conventional cargo strap therein, as well as accepting the hook of various load supporting accessories therein. The first mounting brackets 42 can thus be used independent of the first mounting posts 40 to simply provide additional strap anchoring locations on a shipping container.

The two side flanges 66 of the fastener portion of the first mounting bracket also include two mounting apertures 80 formed therein respectively in alignment with one another such that a threaded fastener can be inserted laterally through the fastener portion 64 of the first mounting bracket in alignment with corresponding mounting apertures in the sides 48 of the mounting post. In this instance, the fastener is perpendicular to the longitudinal direction of the channel and the mounting post while being parallel to the common inner plane and common outer plane of the side wall of the shipping container. The threaded fastener is inserted fully through the first mounting bracket and the mounting post such that a head of the fastener and a nut threaded onto the opposing end of the fastener are both externally accessible at opposing sides of the mounting post.

In a variation of the first mounting bracket 42, an additional mounting plate may extend perpendicularly outward from the front edge of the end plate 70, opposite from the fastener portion 64. The additional mounting plate is intended for positioning flat against a vertical wall portion of the tubular top beam so that additional fasteners can be penetrated into the top beam through fastener apertures in the top beam if additional mounting strength is required.

The configuration of the first mounting bracket and the first mounting post allow various fastening options. In one instance, the mounting bracket may be fastened to the mounting post using a laterally oriented fastener through the mounting apertures 80 prior to mounting of the post within the channel in the side wall of the shipping container. In this instance, the first mounting brackets are secured to the end surfaces of the channel using fasteners inserted only through the fastener apertures 76 located externally of the mounting post within the two side sections 74 of the end plate of the first mounting bracket.

In an alternative mounting arrangement, one or both first mounting brackets 42 may be secured to the end surfaces of the channel prior to connection of the mounting post to the mounting bracket. In this instance, the mounting bracket can be secured to the end surface of the channel using a third fastener inserted through the fastener aperture 76 within the centre section 72 of the first mounting bracket. The access hole 78 in this instance is useful for accessing the centre fastener. The first mounting post can then be subsequently mounted over top of the upper and lower first mounting brackets 42 for fastened connection using a laterally oriented fastener through the mounting apertures 80 in the opposing sides of the first mounting brackets.

The first mounting post 40 in some embodiments may only be secured to the shipping container using a single first mounting bracket 42 connected at the top end thereof. The first mounting post may be suspended only partway along the length of the channel within which it is received in this instance.

Turning now to the second mounting bracket 46, the bracket in this instance again includes a fastener portion 82 which is received through the open end of the mounting post to be contained within the boundary defined by the sides 48 and the crown 50 of the mounting post. The fastener portion of the second bracket also comprises a U-shaped channel having two side flanges 84 which are parallel and spaced apart from one another at opposing sides of the bracket and a bridge portion 86 connected between the two side flanges of the front side thereof. The lateral width or outer dimension of the fastener portion is defined by the two side flanges 84 which are spaced apart so as to be received between the two sides 48 of the mounting post in close proximity thereto. The depth of the side flanges 84 is also sized to be received along the inner surfaces of the sides 48 of the mounting post between the crown 50 at the front side of the post and the rear edges of the two side flanges 48 at the rear of the post. In this manner the rear edges of the side flanges 84 of the mounting bracket 46 are engaged against the panel section of the channel in the mounted position similarly to the rear edges of the side flanges 48 of the mounting post.

The second mounting bracket 46 further includes a hook 88 protruding outwardly from the open end of the mounting post for being hooked onto a respective one of the anchor loops 86 of the shipping container. The hook is formed to include a fastener flange 90 at the base of the hook which is contained within the boundary of the fastener portion 82 of the mounting bracket. More particularly the fastener flange is mounted parallel to the side flanges 84 at a central location therebetween so as to be joined to the bridge flange 86 along the full height thereof at the front edge and so as to extend rearward to a rear edge of the fastener flange lying in a common plane with the rear edges of the two side flanges 84.

The hook 88 further includes a connection portion 92 which extends in the longitudinal direction of the mounting post from the top end of the fastener flange 90 beyond the end of the fastener portion 82 of the second mounting bracket and beyond the end of the second mounting post within which the bracket is received. A rear edge of the connection portion 92 extends in the longitudinal direction of the mounting post to be co-linear with the rear edge of the fastener flange 90 at the rear side of the mounting post. The opposing front edge 94 of the connection portion initially extends upwardly from the bridge flange 86 of the fastener portion at the front side, but then extends upwardly and rearwardly to be continuous with an inner concave edge of the hook 88 thereabove.

The hook 88 further includes a hook portion 96 which protrudes forwardly from the connection portion 92 to protrude forwardly beyond the front side of the fastener portion and the corresponding front side of the second mounting post within which the fastener portion is received. The bottom edge of the hook portion forms the concave inner edge of the hook and terminates at a forward end at a downward and forward slope. The top edge maintains a generally constant distance from the bottom edge to follow a similar radius as the concave inner edge of the hook and the bottom edge of the hook portion.

The hook is formed of a single, flat, continuous plate of material in which the fastener flange 90, the connection portion 92 and the hook portion 96 are coplanar with one another.

A set of three fastener apertures 98 are formed in the fastener flange 90 and the two side flanges 84 respectively in alignment with one another along a common laterally oriented axis such that a laterally oriented threaded fastener can be inserted through all three fastener apertures of the fastener flange 90 and the two side flanges 84 as well as through corresponding apertures in the sides 48 of the second mounting post 44 for fastening the second mounting bracket at the top end of the second mounting post.

Once fastened, the hook is fixed relative to the second mounting post such that the distance measured perpendicularly to the front side of the mounting post between the front edge 94 of the connection portion 92 and the backside of the mounting post is approximately equal to the distance between the rear edge of the rigid anchor loops 36 and the panel section of the channel against which the rear of the mounting post is engaged. In this instance, once the second mounting bracket is anchored to the top end of the second mounting post, the hook is inserted by initially positioning the mounting post to be closer to horizontal than vertical in orientation so that the free end of the hook can be inserted upwardly between the rigid anchor loop and the panel section at the rear of the channel receiving the post therein. By pivoting the bottom end of the mounting post downwardly and rearwardly towards the wall of the shipping container, the hook pivots relative to the anchor loop into an engaged position extending over top of the anchor loop. Once the mounting post assumes a vertical orientation, the depth of the hook occupies the space between the rigid anchor loop and the panel at the rear of the channel to substantially eliminate freedom of movement of the top end of the post towards and away from the side wall of the shipping container in most instances.

The second mounting bracket can be used in various mounting configurations relative to the second mounting post 44. In one instance, a single second mounting bracket is provided at the top end of the second mounting post for insertion into the anchor loop 36 as described above. The bottom end of the mounting post can then be secured in one instance simply by loading of material onto a load supporting accessory on the second mounting post which prevents upward pivotal movement of the bottom end of the mounting post required to release the hook from the anchor loop 36.

Alternatively, a suitable tether 100 may be used for anchoring to another anchor loop 36 at the bottom end of the channel. The tether may be any suitable type of adjustable length cargo strap between opposing hooks in which one hook is anchored to the anchor loop 36 at the bottom of the channel and the other hook is anchored into a lowermost mounting aperture 52 in the mounting post. The other hook may alternatively be anchored to a bolt which is mounted laterally between opposing apertures 54 at opposing sides 48 of the mounting post. Tensioning the strap 100 will prevent displacement of the mounting post out of the channel.

In yet a further arrangement, a pair of second mounting posts may be anchored within respective channels at opposing sides of the interior of a shipping container so that a crossbeam can be mounted to span between the laterally opposed second mounting posts using suitable load supporting accessories 14 which support opposing ends of the crossbeam. The crossbeam in this instance prevents the movement of the bottom ends of the second mounting posts towards one another which would be required to release the hooks. When using a tether 100 or a crossbeam, the second mounting post may extend only partway along the height of the channel from the hook at the top end of the channel.

In yet a further arrangement, the mounting post may span substantially the full height of the channel between the second mounting bracket at the top end and an additional mounting bracket 46 at the bottom end. When securing the bottom end with an additional second mounting bracket 46, the mounting bracket at the bottom end of the second mounting post must be hooked into a respective anchor loop 36 prior to connection of the second mounting bracket to the bottom end of the mounting post. Once the mounting post is positioned vertically within the channel, a lateral fastener extending through the fastener apertures 98 of the second mounting bracket can be used for fastening the second mounting bracket to the second mounting post at the bottom end of the post. The second mounting bracket 46 at the top end of the post may be either connected to the mounting post initially prior to hooking within the anchor loop, or alternatively may be initially hooked within the anchor loop so that the mounting post is subsequently connected to the bracket similarly to the bottom bracket mounting configuration. In this instance, one of the second mounting brackets 46 may be coupled to the mounting post so as to be adjustable in distance relative to the opposing second mounting bracket 46, for example using a longitudinally oriented screw mechanism. The screw mechanism can be operated to mount the second mounting post 44 under tension between the opposing pair of second mounting brackets 46 in this instance.

In some instances, when it is desirable to support elongated items or when supporting elongated shelving members, two mounting posts are used within respective channels at spaced apart positions along a respective side wall. The two mounting posts may both comprise first mounting posts 40, may both comprise second mounting posts 44 or may optionally include one first mounting post 40 and one second mounting post 44. Regardless of the combination of mounting posts used, the mounting apertures 52 and the fastener apertures 54 within the mounting post upon which the load supporting accessories are fastened are arranged to be located at a common elevation relative to corresponding apertures in the other posts so that any load supporting members or loads spanning between load supporting accessories on different mounting posts can be supported in a horizontal orientation parallel to the floor of the shipping container.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A storage system for use with a load supporting accessory for supporting a load thereon and a shipping container having corrugated side walls each formed of inner panel sections in a first common plane at an inner side of the side wall, outer panel sections in a second common plane at an outer side of the side wall, and a plurality of channel sections each connected between one of the inner panel sections and one of the outer panel sections such that each inner panel section together with two adjacent ones of the channel sections defines an outer channel of the side wall open to an exterior and each outer panel section together with two adjacent ones of the channel sections defines an inner channel of the side wall open to an interior, the storage system comprising:

a mounting post arranged to be received in one of the inner and outer channels of the side walls of the shipping container so as to extend in a longitudinal direction along the channel;

a plurality of mounting apertures along the mounting post, each adapted to selectively receive the load supporting accessory therein such that the load can be supported on the mounting post;

a mounting bracket on an end of the mounting post having at least one fastener aperture therein within a mounting surface of the mounting bracket which is oriented perpendicularly to the longitudinal direction of the mounting post such that the mounting bracket is adapted to be fastened to an end surface of the shipping container at an end of the channel receiving the mounting post therein.

2. The system according to claim 1 wherein the mounting post is arranged to be fully received within a boundary of any one of the inner and outer channels of shipping container.

3. The system according to claim 1 wherein the mounting post is arranged to span a full depth of the channel within which the mounting post is received from the first common plane to the second common plane.

4. The system according to claim 1 wherein the mounting post is arranged to span a full height of any one of the inner and outer channels of the shipping container and wherein there is provided a second bracket on an end of the mounting post opposite the mounting bracket, the second bracket having at least one fastener aperture therein within a mounting surface of the second bracket which is oriented perpendicularly to the longitudinal direction of the mounting post such that the mounting bracket is adapted to be fastened to a second end surface of the shipping container at an end of the channel receiving the mounting post therein.

5. The system according to claim 1 wherein the mounting post is arranged to span a full width of the panel section of the channel receiving the mounting post therein between opposing edges of the panel section which are joined to the adjacent ones of the channel sections of the channel.

6. The system according to claim 1 wherein the mounting bracket includes a fastener portion which is received through an open end of the mounting post and wherein there is provided a threaded fastener releasable joining the mounting bracket to the mounting post in which the threaded fastener is perpendicular to the longitudinal direction and parallel to the first and second common planes.

7. The system according to claim 1 wherein the mounting bracket includes a flange portion protruding laterally outward beyond a boundary of the mounting post, the flange portion at least partly defining the mounting surface that locates said at least one fastener aperture therein such that the fastener aperture is located outward of the boundary of the mounting post.

8. The system according to claim 7 wherein the mounting bracket includes two laterally opposed flange portions which are generally triangular in shape such that the two flange portions and the mounting post collectively span the end surface at the end of the channel receiving the mounting post therein.

9. The system according to claim 7 further comprising an auxiliary aperture in the mounting surface of the mounting bracket within the boundary of the mounting post in which the auxiliary aperture is arranged to receive a threaded fastener arranged to be fastened to the end surface of the shipping container at the end of the channel receiving the mounting post therein.

10. The system according to claim 1 for a shipping container comprising a plurality of rigid anchor loops formed at respective ends of some of the channels of each side wall, the system further including a second mounting post assembly, the second mounting post assembly comprising:

a second mounting post arranged to be received in one of the inner channels of the side walls of the shipping container so as to extend in the longitudinal direction along the channel;

a plurality of mounting apertures along a front side of the second mounting post opposite a back side of the mounting post, each mounting aperture being adapted to selectively receive a respective load supporting accessory therein such that the load can be supported on the mounting post;

a mounting bracket on an end of the second mounting post including a hook formed thereon comprising a connection portion extending longitudinally outward from the back side of the mounting post and a hooking portion protruding forwardly from the connection portion towards the front side of the mounting post so as to be arranged for hooking into one of the rigid anchor loops at a top end of the channel receiving the mounting post therein; and a load supporting device coupled across both the load support accessory of the mounting post and the load supporting accessory of the second mounting post.

11. A storage system for use with a load supporting accessory for supporting a load thereon and a shipping container having corrugated side walls each formed of inner panel sections in a first common plane at an inner side of the side wall, outer panel sections in a second common plane at an outer side of the side wall, a plurality of channel sections each connected between one of the inner panel sections and one of the outer panel sections such that each inner panel section together with two adjacent ones of the channel sections defines an outer channel of the side wall open to an exterior and each outer panel section together with two adjacent ones of the channel sections defines an inner channel of the side wall open to an interior, and a plurality of rigid anchor loops formed at respective ends of some of the channels of each side wall, the storage system comprising:

a mounting post arranged to be received in one of the inner channels of the side walls of the shipping container so as to extend in the longitudinal direction along the channel;

a plurality of mounting apertures along a front side of the mounting post opposite a back side of the mounting post, each mounting aperture being adapted to selectively receive the load supporting accessory therein such that the load can be supported on the mounting post; and a mounting bracket on an end of the mounting post including a hook formed thereon comprising a connection portion extending longitudinally outward from the back side of the mounting post and a hooking portion protruding forwardly from the connection portion towards the front side of the mounting post so as to be arranged for hooking into one of the rigid anchor loops at a top end of the channel receiving the mounting post therein.

12. The system according to claim 11 wherein the mounting post is arranged to be fully received within a boundary of any one of the inner channels of shipping container.

13. The system according to claim 11 wherein the mounting post is arranged to span a full depth of the channel within which the mounting post is received from the first common plane to the second common plane.

14. The system according to claim 11 wherein the mounting post is arranged to span a full width of the panel section of the channel receiving the mounting post therein between opposing edges of the panel section which are joined to the adjacent ones of the channel sections of the channel.

15. The system according to claim 11 wherein the mounting bracket includes a fastener portion which is received through an open end of the mounting post and wherein there is provided a threaded fastener releasable joining the mounting bracket to the mounting post in which the threaded fastener is perpendicular to the longitudinal direction and parallel to the first and second common planes.

16. The system according to claim 11 wherein the connection portion of the hook includes a front edge positioned relative to the back side of the mounting post such that the front edge of the connection portion of the hook is arranged to be engaged against a back side of the anchor loop when the back side of the mounting post abuts the panel section of the channel along a full length of the mounting post in the longitudinal direction.

17. The system according to claim 16 wherein the connection portion of the hook is formed of plate material fully spanning in a depth direction between the back side of the anchor loop and the panel section of the channel against which the back side of the mounting post is arranged to be abutted.

18. The system according to claim 17 wherein the connection portion of the hook includes a fastener portion which is received through an open end of the mounting post and wherein there is provided a threaded fastener releasable joining the fastener portion mounting bracket to the mounting post in which the threaded fastener is perpendicular to the longitudinal direction and parallel to the first and second common planes.

19. The system according to claim 11 including two mounting posts which are identical such that each mounting post has a mounting bracket with a hook formed thereon, and a cross beam adapted to be connected perpendicularly between the two mounting posts when the mounting posts are mounted on respective anchor loops on opposing side walls of the shipping container.

20. A storage system in combination with load supporting accessories and a shipping container having corrugated side walls each formed of inner panel sections in a first common plane at an inner side of the side wall, outer panel sections in a second common plane at an outer side of the side wall, a plurality of channel sections each connected between one of the inner panel sections and one of the outer panel sections such that each inner panel section together with two adjacent ones of the channel sections defines an outer channel of the side wall open to an exterior and each outer panel section together with two adjacent ones of the channel sections defines an inner channel of the side wall open to an interior, and a plurality of rigid anchor loops formed at respective ends of some of the channels of each side wall, the storage system comprising:

a first mounting post arranged to be received in one of the inner and outer channels of the side walls of the shipping container so as to extend in a longitudinal direction along the channel;

a plurality of mounting apertures along the first mounting post, each adapted to selectively receive one of the load supporting accessories therein;

a first mounting bracket on an end of the first mounting post having at least one fastener aperture therein within a mounting surface of the mounting bracket which is oriented perpendicularly to the longitudinal direction of the mounting post such that the mounting bracket is adapted to be fastened to an end surface of the shipping container at an end of the channel receiving the mounting post therein;

a second mounting post arranged to be received in one of the inner and outer channels of the side walls of the shipping container so as to extend in the longitudinal direction along the channel;

a plurality of mounting apertures along a front side of the second mounting post opposite a back side of the mounting post, each mounting aperture being adapted to selectively receive one of the load supporting accessories therein such that the load can be supported on the mounting post;

a second mounting bracket on an end of the second mounting post including a hook formed thereon comprising a connection portion extending longitudinally outward from the back side of the second mounting post and a hooking portion protruding forwardly from the connection portion towards the front side of the second mounting post so as to be arranged for hooking into one of the rigid anchor loops at a top end of the channel receiving the mounting post therein; and a load supporting device coupled horizontally across both the load support accessory of the first mounting post and the load supporting accessory of the second mounting post.

* * * * *